United States Patent [19]

Mandel et al.

[11] 4,063,620

[45] Dec. 20, 1977

[54] ELEVATOR SYSTEM

[75] Inventors: Alan F. Mandel, Pittsburgh, Pa.; Andrew F. Kirsch, Edison, N.J.; Kenneth M. Eichler, McKeesport, Pa.

[73] Assignee: Westinghouse Electric Corporation, Pittsburgh, Pa.

[21] Appl. No.: 703,890

[22] Filed: July 9, 1976

[51] Int. Cl.[2] ..... B66B 1/18

[52] U.S. Cl. ..... 187/29 R

[58] Field of Search ..... 187/29

[56] References Cited

U.S. PATENT DOCUMENTS

| | | | |
|---|---|---|---|
| 3,443,668 | 5/1969 | Hall et al. | 187/29 |
| 3,450,231 | 6/1969 | Kuzara | 187/29 |
| 3,511,342 | 5/1970 | Hall et al. | 187/29 |
| 3,851,733 | 12/1974 | Sackin et al. | 187/29 |
| 3,851,734 | 12/1974 | Sackin | 187/29 |

*Primary Examiner*—Robert K. Schaefer
*Assistant Examiner*—W. E. Duncanson, Jr.
*Attorney, Agent, or Firm*—D. R. Lackey

[57] ABSTRACT

An elevator system having a plurality of elevator cars and supervisory control for directing their movement in a building to efficiently serve the floors therein. The supervisory control divides the work load uniformly among the elevator cars by periodically assigning, clearing and reassigning service directions from the floors to the cars according to a predetermined strategy. The predetermined strategy accords special treatment for assigning the service directions from floors at which each car will stop and depart in a predetermined direction due to register car calls. The strategy includes special limitations on such car call related assignments to improve elevator service, with one embodiment limiting such car call related assignments to a predetermined number N, which are the N closest car calls ahead of the car. Another embodiment provides a dynamic limitation on car call related assignments by counting the stops due to car calls and previously committed hall calls ahead of each car, and making a car call related assignment only when it is within a predetermined number of stops ahead of the car.

13 Claims, 7 Drawing Figures

ELEVATOR SYSTEM

BACKGROUND OF THE INVENTION

Copending Application Ser. Nos. 574,662; 574,829; and 574,664, filed May 5, 1975, which are continuations-in-part of abandoned application Ser. Nos. 503,146; 503,201; and 503,212, respectively, filed Sept. 4, 1974, which are all assigned to the same assignee as the present application, disclose a new and improved elevator system in which the strategy utilized by the supervisory control is suitable for implementation by a microprocessor. These applications are hereby incorporated into the present application by reference, and will be hereinafter referred to as the incorporated applications.

The microprocessor offers an attractive cost package as well as flexibility due to the LSI circuitry and programmability. While the microprocessor offers programming flexibility at a modest cost, it imposes certain restrictions due to its relatively limited speed and memory capacity. The incorporated applications set forth a universal elevator operating strategy which accommodates all possible building configurations in which an elevator car may serve any combination of floors. The car controllers provide complete information to the system processor as to the building configuration which exists at any instant, and thus the supervisory control may be universally applied to any building without any significant modification of the control.

The universal operating strategy operates within the limited operating speed of a microprocessor, because it does not decide when a hall call is registered which elevator car should serve the hall call and then output the assignment of the call in a timely manner to a car. Rather, it periodically assigns the up and down service directions, also called up and down scan slots, respectively, of the floors to the cars by dividing them among all in-service elevator cars within the constraints of predetermined dynamic averages, which distributes the work load evenly among all of the elevator cars. Thus, the car assigned to a specific service direction from a floor will immediately see a hall call registered therefrom without any intercession required on the part of the supervisory control system.

Before each new assignment process, the supervisory system control clears all previously assigned scan slots or landing service directions which do not have a registered hall call associated therewith. The supervisory system control then assigns the unassigned scan slots in a plurality of assignment passes, such as three. During the initial assignment pass, each scan slot is examined to see if a car has a car call for the floor associated therewith. If so, a car set for up travel is assigned the up scan slot for this floor if it is not already assigned, and it is not a terminal floor for this car. If it is a terminal floor it would be assigned the down scan slot for this floor. If the car is set for down travel it would be assigned the down scan slot for this floor if it is not already assigned, and it is not a terminal floor for this car. If it is a terminal floor it would be assigned the up scan slot for this car. On the subsequent assignment passes, the scan slots not already assigned are assigned to the cars. The scan slot assignments are made within the restrictions of certain dynamic calculated averages in order to divide the currently existing work load as evenly as possible among all of the in-service elevator cars.

SUMMARY OF THE INVENTION

Briefly, the present invention improves upon the universal operating strategy of the elevator system disclosed in the incorporated applications. While the universal operating strategy of the incorporated applications provides excellent elevator service, in certain circumstances it is possible for the answering of a hall call to be unduly delayed. The strategy of the incorporated applications, wherein scan slots associated with car calls are automatically assigned during each assignment process to the car having the car call could co-act with the strategy which does not clear scan slot assignments having an associated hall call, to provide an unnecessary delay in answering a hall call. This adverse co-action between these two strategies occurs when a car has a large number of car calls, which results in the assigning of the associated scan slots to this car. Then, before the next assignment process, a hall call is entered for one of the scan slots assigned to this car which is associated with a car call which will not be answered until the car stops for several other registered car calls. This scan slot associated with the hall call will not be cleared and reassigned during the next assignment process, but will be retained by a car which has many intermediate car call stops and possibly even hall call stops to make.

The present invention precludes an adverse co-action between the above-mentioned operating strategies of the incorporated applications by including a limit function in the supervisory control which places a limit or automatic car call related assignments. In one embodiment of the invention, the car call related scan slot assignments, which start at the closest car call to the location of the car and proceed to the farthest, are counted. When a predetermined number N of such car call related assignments are made to a car, such as two, or three, as desired, this car will not be assigned by additional scan slots during this assignment process because they are related to its car calls. Thus, by the assignment process which starts at the location of the car and proceeds to assign scan slots in the travel direction of the car, each car will be assigned a maximum of N scan slots related to its car calls, and these scan slots will be the N closest car calls to the car.

In another embodiment of the invention, instead of counting the number of car call related scan slot assignments and cutting off such automatic assignments after a predetermined number N have been made, stops to which the car is committed to make due to car and hall calls are counted. These stops are counted while proceeding from the car in its travel direction, and car call related scan slot assignments are made only if the floor associated with the car call is included in the first N stops, such as three stops, that the car is committed to make. Thus, for example if a car has two hall calls assigned to it and the number N is three, only one car call related scan slot assignment will be made to this car if both hall calls will be encountered before reaching the second closest car call.

BRIEF DESCRIPTION OF THE DRAWING

The invention may be better understood, and further advantages and uses thereof more readily apparent, when considered in view of the following detailed description of exemplary embodiments, taken with the accompanying drawings, in which.

DESCRIPTION OF PREFERRED EMBODIMENTS

Figure 1:
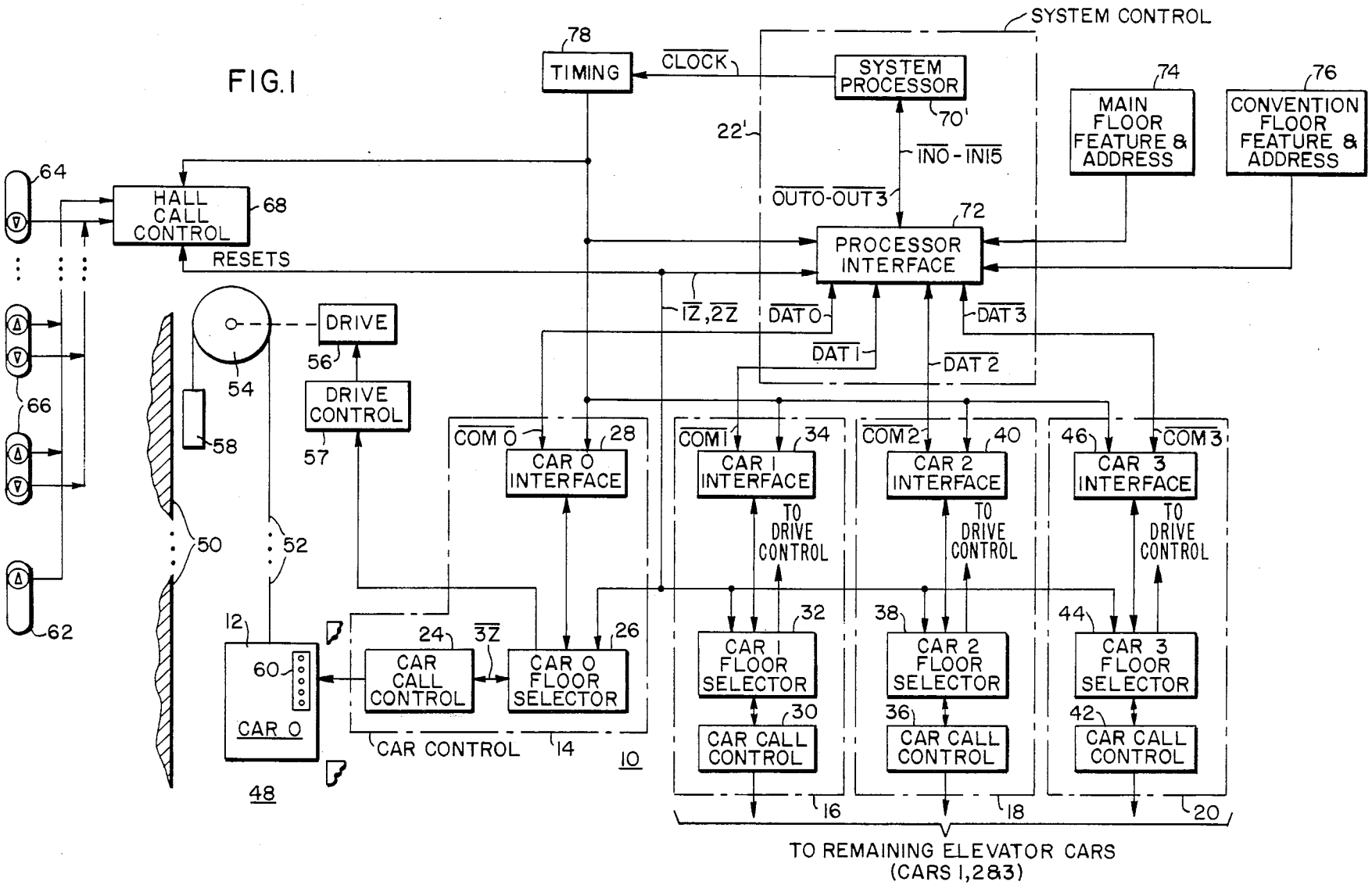
FIG. 1 is a partially schematic and partially block diagram of an elevator system, including supervisory system control, which may utilize the teachings of the invention.

The present application relates to modifications and improvements to the elevator system disclosed in the incorporated applications. Only those portions of the incorporated applications which are necessary to understand and practice the present invention will be described in detail. Apparatus and steps of the incorporated applications which are shown in the present application and are unchanged by the present invention are identified with like reference numerals. Reference numerals in the present application which include a prime mark indicate the referenced apparatus or step of the incorporated applications has been modified by the present application. New reference numerals are used to indicate apparatus and steps which are not shown in the incorporated applications.

Referring now to the drawings, and FIG. 1 in particular, there is shown an elevator system 10 which may utilize the teachings of the invention. Elevator system 10 includes a bank of elevator cars, with car controls 14, 16, 18 and 20 for four cars being illustrated for purposes of example. Only a single car 12 is illustrated, associated with car control 14, in order to simplify the drawing, since the remaining cars would be similar. Each car control includes a car call control function, a floor selector function, and an interface function for interfacing with supervisory system control 22'. The supervisory system control 22' controls the operating strategy of the elevator system as the elevator cars go about the business of answering hall calls.

More specifically, car control 14 includes car call control 24, a floor selector 26, and an interface circuit 28. Car control 16 includes car call control 30, a floor selector 32, and an interface circuit 34. Car control 18 includes car call control 36, a floor selector 38, and an interface circuit 40. Car control 20 includes car call control 42, a floor selector 44, and an interface circuit 46. Since each of the cars of the bank of cars and their controls are similar in construction and operation, only the controls for car 12 will be described in detail.

Car 12 is mounted in a hatchway 48 for movement relative to a building 50 having a plurality of floors or landings, with only a few landings being illustrated in order to simplify the drawing. The car 12 is supported by ropes 52 which are reeved over a traction sheave 54 mounted on the shaft of a suitable drive motor 56. Drive motor 56 is controlled by drive control 57. A counterweight 58 is connected to the other end of the ropes 52.

Car calls, as registered by pushbutton array 60 mounted in the car 12, are recorded and serialized in the car call control 24, and the resulting serialized car calls $\overline{3Z}$ are directed to the floor selector 26.

Hall calls, as registered by pushbuttons mounted in the halls, such as the up pushbotton 62 located at the bottom landing, the down pushbutton 64 located at the uppermost landing, and the up and down pushbuttons 66 located at the intermediate landings, are recorded and serialized in hall call control 68. The resulting up and down serialized hall calls $\overline{1Z}$ and $\overline{2Z}$, respectively, are directed to the floor selectors of all of the elevator cars, as well as to the supervisory system control 22.

The floor selector 26 keeps track of the car 12 and the calls for service for the car, and provides signals for the drive control 57. The floor selector 26 also provides signals for controlling such auxiliary devices as the door operator and hall lanterns, and it controls the resetting of the car call and hall call controls when a car or hall call has been serviced.

The present invention relates to new and improved group supervisory control for controlling a plurality of elevator cars as they go about the task of answering calls for elevator service, and any suitable floor selector may be used. For purposes of example, it will be assumed that the floor selector disclosed in U.S. Pat. No. 3,750,850, issued Aug. 7, 1973, will be used, which patent is assigned to the same assignee as the present application. This patent describes a floor selector for operating a single car, without regard to operation of the car in a bank of cars. U.S. Pat. No. 3,804,209, issued Apr. 16, 1974, discloses modifications to the floor selector of Pat. No. 3,750,850 to adapt it for control by a programmable system processor. In order to avoid duplication and limit the complexity of the present application, these patents, which are assigned to the same assignee as the present application, are hereby incorporated into this application by reference.

The supervisory system control 22' includes a processing function 70' and an interface function 72. The processing function 70' receives car status signals $\overline{DAT0}$–$\overline{DAT3}$ from the car controllers, via the interface function 72 which processes all of the inputs and provides a plurality of serialized input signals $\overline{IN0}$–$\overline{IN15}$ for the system processor, as well as the up and down hall calls $\overline{1Z}$ and $\overline{2Z}$, respectively. The system processor 70' prepares assignment words $\overline{OUT0}$–$\overline{OUT3}$ for the elevator cars, which are processed by the interface 72 and applied to the car controllers as assignment words $\overline{DAT0}$–$\overline{DAT3}$. The assignment words direct the elevator cars to serve the calls for elevator service according to a predetermined strategy. The car status signals $\overline{DAT0}$–$\overline{DAT3}$ provide information for the processing function 70' relative to what each car can do in the way of serving the various floors of the building, and the processing function 70' makes assignments based upon this car supplied information.

Special floor features, shown generally at 74 and 76, may be activated to provide special strategies relative to first and second selectable floors, respectively.

The supervisory system control 22' provides a timing signal $\overline{CLOCK}$ for synchronizing a system timing function 78. The system timing function 78 provides timing signals for controling the flow of data between the various functions of the elevator system. The elevator system 10 is basically a serial, time multiplexed system, and precise timing must be generated in order to present data in the proper timed relationship. Each floor of the building to be serviced is assigned to its own time or scan slot in each time cycle, and thus the number of time slots in a cycle is dictated by the number of floors in the associated building. Each floor has a different timing scan slot associated therewith, but it is not necessary that every scan slot be assigned to a floor level. Scan slots are generated in cycles of 16, 32, 64 or 128, so the specific cycle is selected such that there will be at least as many scan slots available as there are floor levels. For purposes of example, it will be assumed that there are 16 floors in the building described herein, so the cycle with 16 scan slots will be sufficient.

The 16 scan slot cycle is generated by a binary counter. For example, the binary address of scan slot 00 is 0000, and the binary address of scan slot 01 is 0001, etc.

Figure 2:
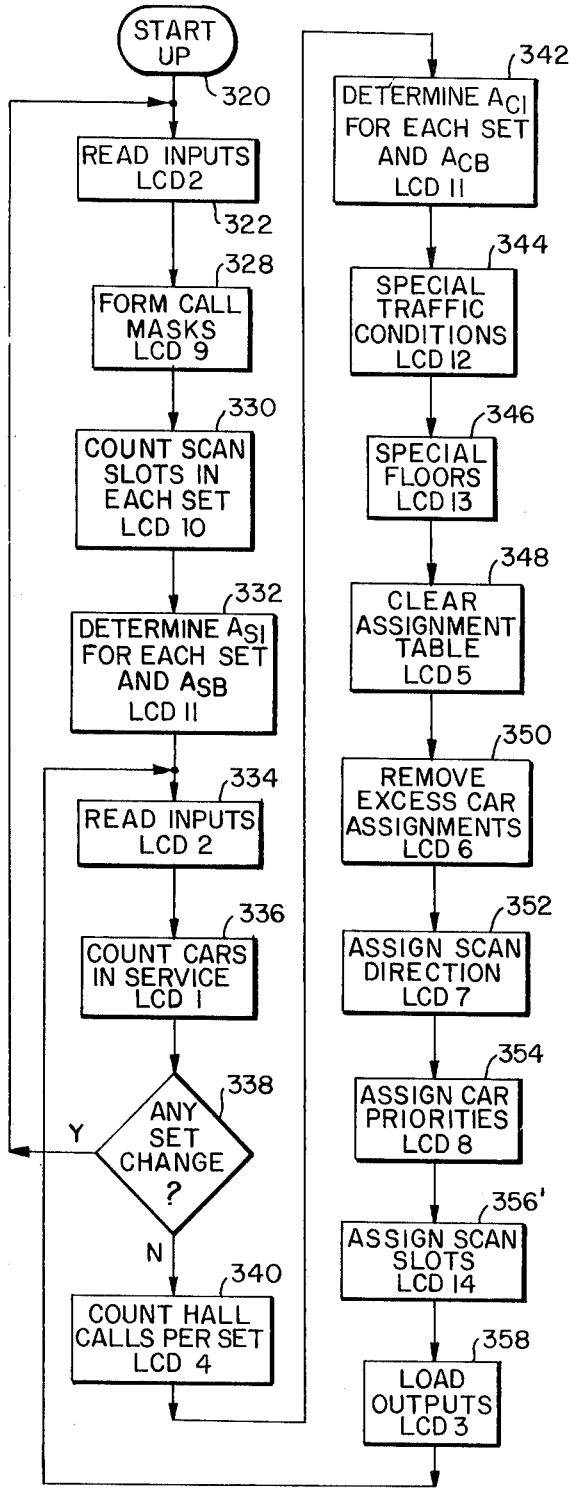
FIG. 2 is a block diagram which illustrates group supervisory strategy for controlling a plurality of elevator cars, which strategy may utilize the teachings of the invention.

FIG. 2 is a block diagram which broadly sets forth new and improved group supervisory strategy for controlling a bank of elevator cars to answer calls for elevator service according to the teachings of the invention. The system shown in FIG. 2 outlines a program for implementing the strategy of the invention, with each of the blocks shown in FIG. 2 being fully developed in flow charts included in the hereinbefore mentioned copending applications. The present application includes detailed flow charts for those portions of the program to which the invention is directed. The flow charts which are included in the present application are programmers flow charts, which, when taken with the remaining figures, the specification, the hereinbefore mentioned copending applications, and a users manual for a microprocessor, provide sufficient detail for a programmer of ordinary skill to write the necessary instructions to program the microprocessor. The blocks of FIG. 2 also include an LCD identification number which refers to subprograms shown in the flow charts.

In general the new and improved group supervisory strategy is universal in character, enabling it to be applied without significant modification to any building. The system processor is completely dependent upon information from the various car controllers as to what each car is capable of doing. The system processor uses this information to set up the specific building configuration which presently exists, i.e., which cars are in service and which floors and service directions therefrom these in-service cars are enabled to serve. The system processor then applies its universal strategy to this configuration.

The universal strategy attempts to evenly distribute, among all in-service cars, the actual work load, as well as the work load which may arise between assignments. The distribution of this actual and possible work load is based upon certain dynamic averages calculated just prior to the making of assignments.

The assignments are primarily "hall button" oriented, rather than "hall call" oriented, at least until the hall calls "assigned" to a car because of the assignment of hall buttons meets one of the applicable dynamic averages. Each hall call button is effectively assigned a scan slot, and these scan slots are assigned to the cars according to the universal strategy. The elevator system is a serial, time multiplexed arrangement in which the scan slots for the floors are taken in turn.

The assignment of scan slots to the various cars is not made on the basis of an inflexible block of adjacent floors, normally associated with the zone concept, it is not made on the basis of a flexible block of adjacent floors normally associated with the floating zone concept between adjacent cars, and it is not a random operation. The assignment of scan slots is built into a predetermined priority structure which includes:

1. the clearing of certain scan slot assignments before each assignment process;

2. the assignment of scan slots in a general order based upon the floors served by the same combination of cars, with each such group being called a "set;"

3. the assignment of the scan slots of the sets in a plurality of assignment passes, changing the limitations applied and controlling dynamic averages on each pass, with the limitations and dynamic averages including those which are set oriented, as well as building oriented;

4. the assignment of scan slots to the cars enabled for each set according to a dynamic car priority order, calculated prior to each assignment process on the basis of actual work load, 5. the assignment of scan slots to the cars, starting from the cars in a predetermined direction, with the predetermined direction for a busy car being its travel direction and with a predetermined direction for an idle car being based upon the currently existing traffic conditions and the assignment directions for the busy cars;

6. the assignment of scan slots to busy cars with the limitation that the associated floors are within a predetermined travel distance from the car, as opposed to physical separation; and 7. assigning scan slots to in-service idle cars without the travel distance limitation of 6.

The description of the assignment process refers to the assignment of scan slots to the cars. The scan slots are each associated with a different hall call pushbutton, and the hall call pushbuttons are related to directions from the floors that traffic located at the floors desires to travel. Thus, the assignment of scan slots to the cars may be considered to be the assignment of landings, and service directions therefrom, to the cars, or briefly, the assignment of service directions from landings to the cars. It should be noted that the term "service direction," when applied to landings in the assignment process, refers to the direction from the floor that traffic at the floor desires to travel, and is not related to the setting of the service directions for the various elevator cars.

More specifically, startup of the elevator system 10 shown in FIG. 1 is indicated at terminal 320 of FIG. 2. Step 322 reads the input signals from the various cars, and stores the signals in the data storage memory.

Step 328 forms down and up call masks. The call masks are stored in the memory of the system processor 70, and they indicate for each car, the floors and directions therefrom which may be served by the car. This arrangement preserves the universality of the program, making it applicable to any building configuration, as the program obtains the information as to the building configuration from the cars, and then stores the building configuration for reference until a change occurs.

Step 330 counts the scan slots in each set as well as the total number of scan slots in the building and stores these sums for future reference. Each hall call pushbutton is assigned a scan slot. Thus, in a building with 16 levels, the first and sixteenth levels would have 1 scan slot, and the intervening 14 floors or levels would each have 2 scan slots, making a total of 30 scan slots. A set refers to a group of floors served by the same combination of cars. If all cars serve all floors, there would only be 1 valid set. In the average building configuration, there would usually only be a few sets, but the program will handle the maximum number of sets possible.

Step 332 determines the average number of scan slots per set, $A_{SI}$, by dividing the scan slots in each set, determined in step 330, by the number of in-service cars capable of serving the set. Step 332 also determines $A_{SB}$, the average number of scan slots in the building per in-service elevator car, by dividing the total number of scan slots in the building by the number of cars in service ($N_{SC}$).

Steps 334 and 336 then repeat steps 332 and 336, respectively, reading the input port of the system processor 70' and counting the cars in service. Step 338 determines if there has been a change in the building configuration since the last reading of the input port. For example, step 338 determines if the number of in-service cars has changed. If there has been a change, the program returns to step 322, as the floor enable masks and scan slot averages previously formulated may no longer be valid, and thus should be updated using the latest building configuration.

If step 338 finds that there has been no change which invalidates $N_{SC}$, $A_{SB}$, or $A_{SI}$ for any set, the program advances to step 340. Step 340 counts the number of hall calls per set, as well as the total number of hall calls in the building, and stores these sums for future reference.

Step 342 determines the average number of registered hall calls per set, $A_{CI}$, by dividing the number of hall calls in each set by the number of in-service cars serving the set. The average number of registered hall calls per car in the building, $A_{CB}$, is determined by dividing the total number of hall calls in the building by $N_{SC}$, the number of in-service elevator cars.

Step 344 checks for special traffic conditions, such as those which initiate up peak and down peak features. If a condition is detected which initiates a peak traffic condition, step 344 implements the strategy associated with the specific peak detected.

Step 346 checks for special floor features, such as main and convention floor features. If a request for one or more special floor features is present, step 346 implements the strategy associated with the special floor features selected.

Step 348 clears the up and down assignment tables, stored in the memory of system processor 70', of all scan slot assignments except those previously assigned scan slots which have a registered hall call associated therewith, and those scan slots from a one car set.

Step 350 removes any excess scan slot assignments. For example, if the number of calls from a one car set assigned to the car equals or exceeds the hall call per car building average $A_{CB}$, all other assignments to this car are cleared. If the calls assigned to a car from a one car set do not exceed $A_{CB}$, but all calls assigned to the car equals or exceeds $A_{CB}$, step 350' counts the scan slots assigned to the car which have a registered hall call, starting at the scan slot associated with the position of the car and proceeding in the travel direction of the car, and once the building call average per car $A_{CB}$ is met, all further scan slots assigned to this car are cleared.

Step 352 assigns the direction from an in-service idle car in which the assignment of scan slots are to be made to the car. If a car is busy, the scan direction for assigning scan slots to the car is the car's travel direction. The assigned scan directions of the busy cars are considered, along with the present traffic conditions, in deciding the scan direction to be assigned to an in-service idle car. In certain instances it is also suitable to use the last travel direction of an in-service idle car.

Step 354 assigns the order in which the cars are to be considered when assigning scan slots to them, with the car having the fewest combined car and hall calls being considered first, etc.

Figure 6:
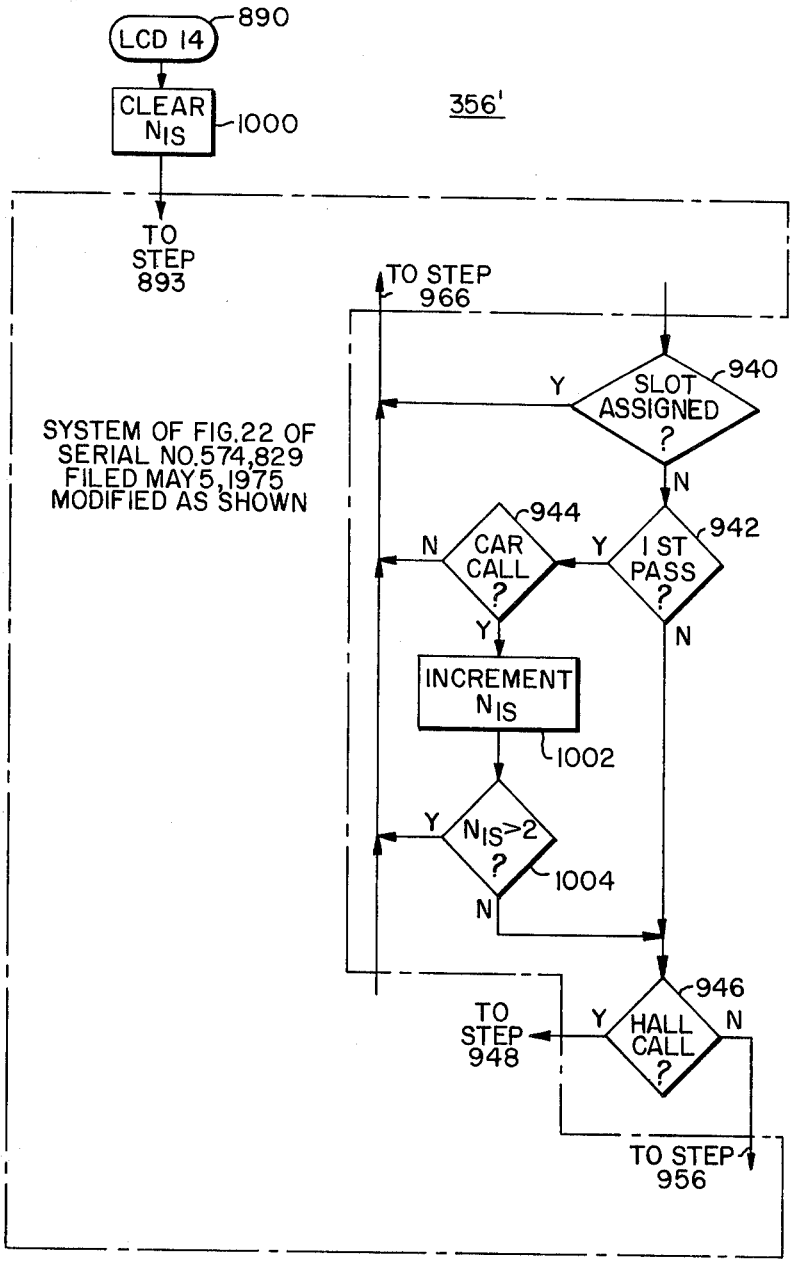
FIGS. 6 and 7 illustrate modifications to a subprogram of the incorporated applications, for implementing the assignment of scan slots according to the first and second embodiments, respectively, of the invention.
Figure 7:
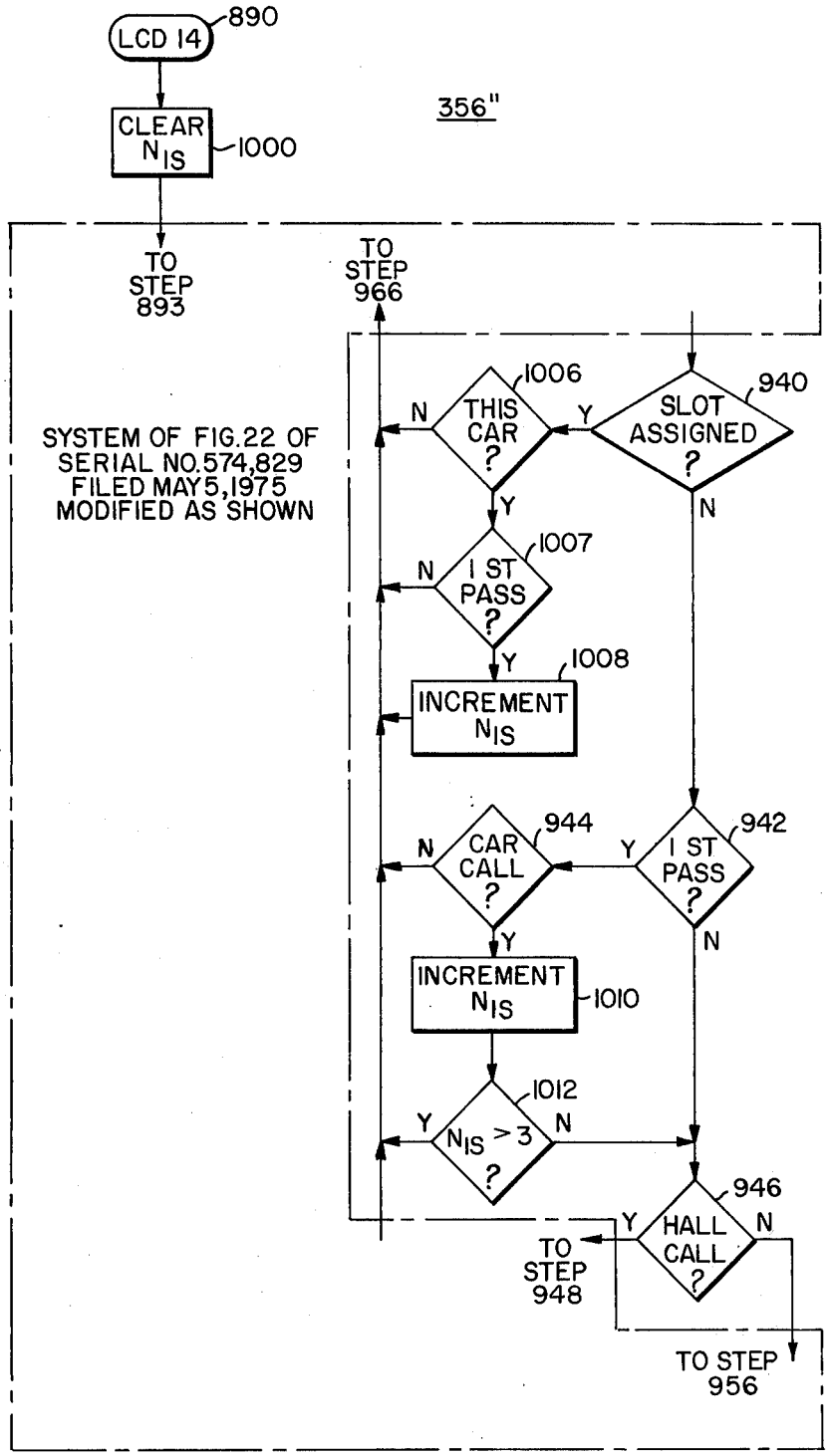

Step 356' assigns the scan slots of each set to the cars, in the car order determined by step 354. The sets are considered in the order of increasing number of cars per set. The assignment of the scan slots to the cars associated with each set are made in a plurality of passes, such as three. The first assignment pass is a specific assignment pass which takes care of pre-identified situations and priorities. Scan slots associated with floors for which the cars have a car call are assigned to the appropriate cars, during this first assignment pass, according to the teachings of the invention. The second pass is a general assignment which assigns scan slots to the cars of the sets subject to predetermined dynamic limiting averages and a distance limitation. A third pass may be used to try to assign any unassigned scan slots which may remain after the first two passes. The third pass removes certain limitations used during the second pass. Changes to the detailed flow chart for step 356', which implement the modifications to the basic strategy according to the teachings of the invention, are shown in FIGS. 6 and 7.

Step 358 reads the memory of the system processor 70' to the output port of the data storage memory, where the information appears as serial output signals $\overline{OUT0}$, $\overline{OUT1}$, $\overline{OUT2}$ and $\overline{OUT3}$ for cars, 0, 1, 2 and 3, respectively.

After outputting the assignments to the cars, the program returns to step 334, hereinbefore described.

Step 356', during the first or initial assignment pass of each assignment process, which occurs every 1 to 3 seconds in order to maintain the assignments current, assigns car call related scan slots to the cars. In the strategy of step 356 of the incorporated applications, scan slots related to car calls are assigned to the associated elevator cars without limitation, other than the dynamic averages related to hall call and scan slot assignments. It has been found that this strategy, along with the strategy of step 348 of FIG. 2 which clears the scan slot assignments prior to each assignment process, unless the scan slot has a hall call associated therewith, may co-act unfavorably in certain instances to unduly delay the answering of a hall call.

Figure 3:
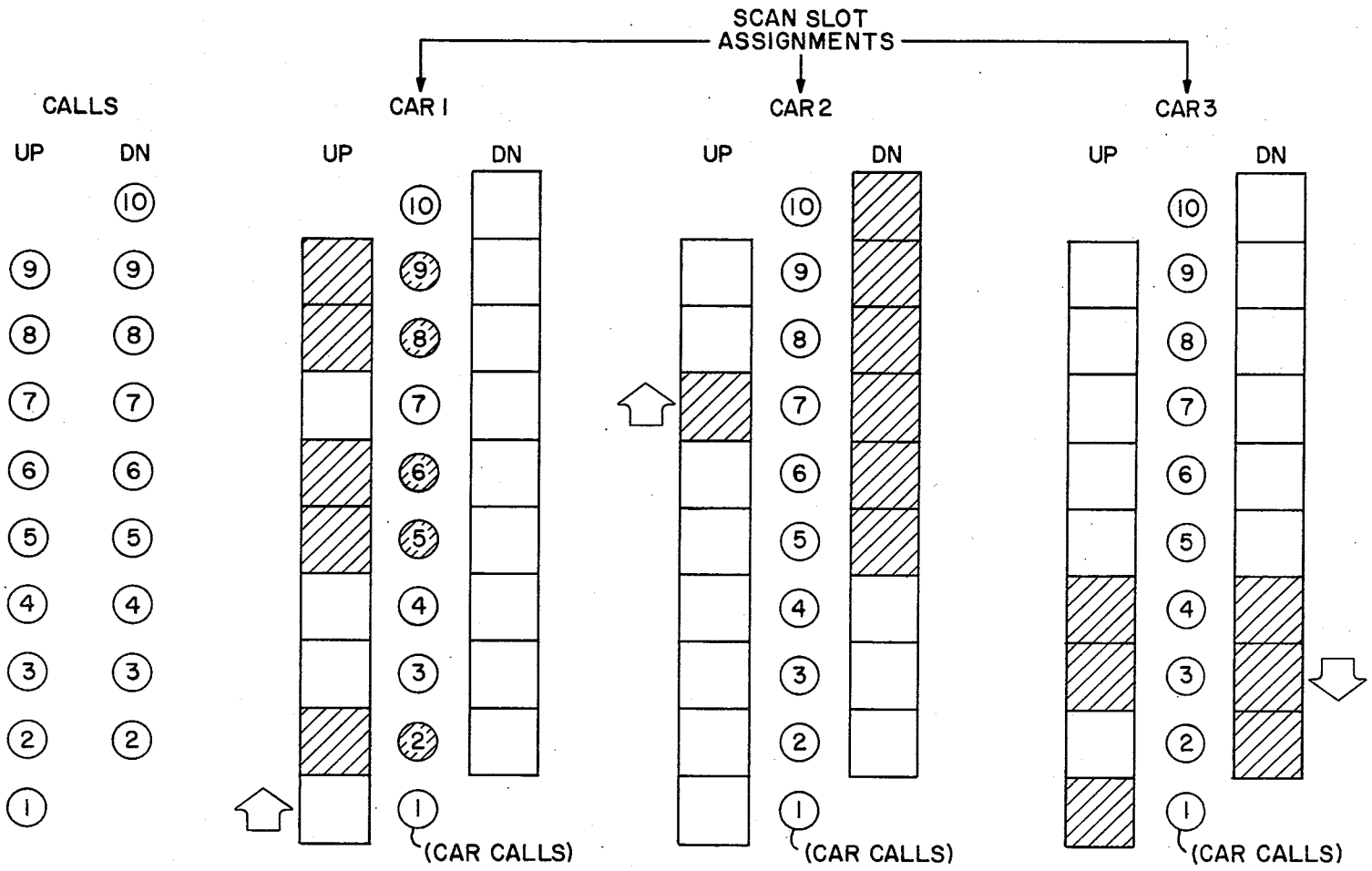
FIG. 3 is a chart which illustrates an example of scan slot assignments which may be made according to the strategy of the incorporated applications.

FIG. 3 is a chart which illustrates a traffic situation which may occur and result in the delayed answering of a hall call. For purposes of example, the chart of FIG. 3 illustrates of 3 car elevator system mounted in a building having 10 floors. The up and down scan slot assignments to the elevator cars associated with the up and down service directions from the floors are illustrated by the shaded blocks. Registered car and hall calls are illustrated with a shaded circle having a number therein which identifies the associated floor, and the position and service direction of each car is illustrated by an arrow head.

Car 1, which is located at the first floor, has car calls registered for floors, 2, 5, 6, 8, and 9, and according to the strategy of the incorporated applications, the up slots for floors 2, 5, 6, 8 and 9 will be assigned to car 1 during the first assignment pass of step 356. Car 2, located at the seventh floor with no car calls and no hall calls in previously assigned scan slots, would be assigned the up scan slot for the seventh floor and down scan slots from floor Nos. 10, 9, 8, 7, 6 and 5. Car 3, located at the third floor with no car calls and no hall calls in previously assigned scan slots, would be assigned down scan slots from the third and second floors, up scan slots from the first, third and fourth floors, and the down scan slot from the fourth floor.

If an up hall call is now registered from floor 9, car 1 will retain the up scan slot from floor 9 until it answers the hall call, because step 348, during the next running of the program, will not clear this scan slot assignment. Car 1, however, has four stops to make before reaching the up hall call at the 9th floor, and the passenger waiting time will be quite long, at a time when there are 2 idle cars.

The potential for excessive waiting times for hall calls associated with the strategy of the incorporated applications, illustrated in the chart of FIG. 3, is reduced according to a first embodiment of the invention, without requiring major modification to the basic strategy, by providing a fixed maximum limitation on the number of scan slots assigned to a car during the first assignment pass because of the cars' registered car calls, and to apply this fixed number N to the N closest car calls.

Figure 4:
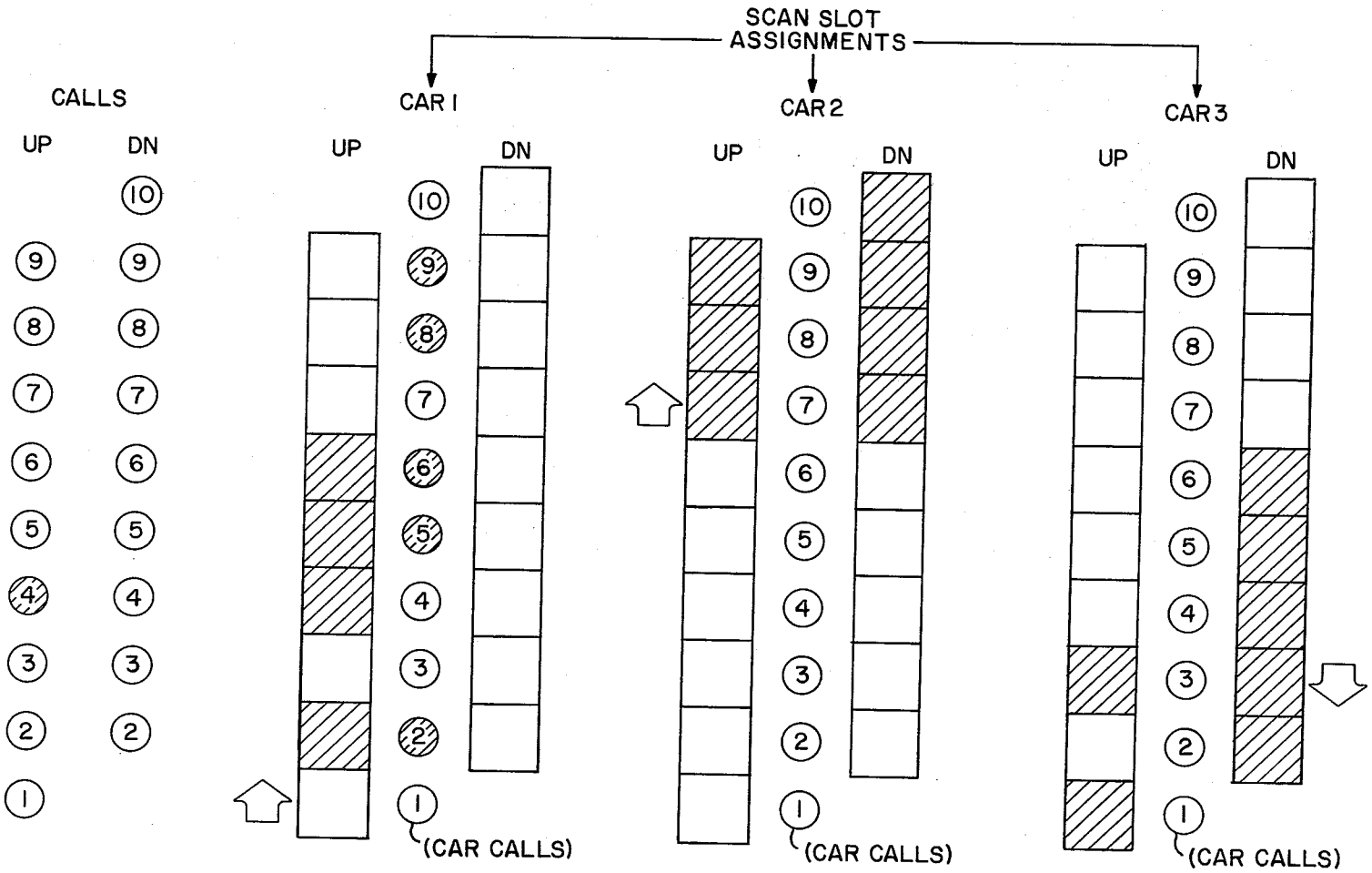
FIGS. 4 and 5 are charts which illustrate examples of scan slot assignments made according to the teachings of first and second embodiments of the invention, respectively.

FIG. 4 is a chart which illustrates how this modification of the basic strategy improves upon the situation illustrated in the chart of FIG. 3. For purposes of example, the assignment of car call related scan slots to any car during the first assignment pass will be limited to three, i.e., N=3.

First, it will be assumed that there are no registered hall calls in the building. In the first assignment pass, instead of car 1 receiving up scan slot assignments associated with floors, 2, 5, 6, 8 and 9, it will be limited to the three car calls which are closest to the car position. Thus, car 1 will be assigned the up scan slots for floors 2, 5 and 6. Car 2 will receive up scan slot assignments for floors 7, 8 and 9, and down scan slot assignments from floors 10, 9, 8 and 7, and car 3 will receive down scan slot assignments for floors 3 and 2, up scan slot assignments for floors 1 and 3, and down scan slot assignments for floors 6, 5 and 4.

Now, if an up hall call is registered at floor 9, car 2 will immediately answer the call, even though car 1 will be stopping at floor 9 with a car call.

Now it will be assumed that car 1 has been assigned the up scan slot for floor 4 during a previous assignment process, and that there is an up hall call registered at floor 4. Thus, car 1 will retain the up scan slot for floor 4, and in addition car 1 will be assigned the up scan slots associated with the three closest car calls, i.e., the up scan slots for floors 2, 5 and 6. If an up hall call is now registered from floor 6, car 1 will retain this scan slot assignment, but the prospective passenger at the 6th floor will have to wait until car 1 makes three intervening stops at the 2, 4 and 5 floors, even though there are two idle cars in the system. Thus, while the strategy of limiting the car call related scan slot assignments to the N closest car calls improves upon the basic strategy of the incorporated applications, it still may be subject to undue delays in the answering of a hall call.

The universal strategy of the incorporated applications is further improved, according to a second embodiment of the invention, by eliminating the potential problems pointed out in the charts of FIGS. 3 and 4. In this embodiment, the number of car call related assignments made to a car during the first assignment pass is dynamically limited to the N closest stops to be made by the associated elevator car. This strategy takes into consideration stops to be made by a car due to its car calls and also due to hall calls in retained assigned scan slots. The limit is referred to as a dynamic limit, as the number of car call related scan slot assignments during the first pass may be N, N-1, N-2, down to and including 0, notwithstanding more than N registered car calls.

Figure 5:
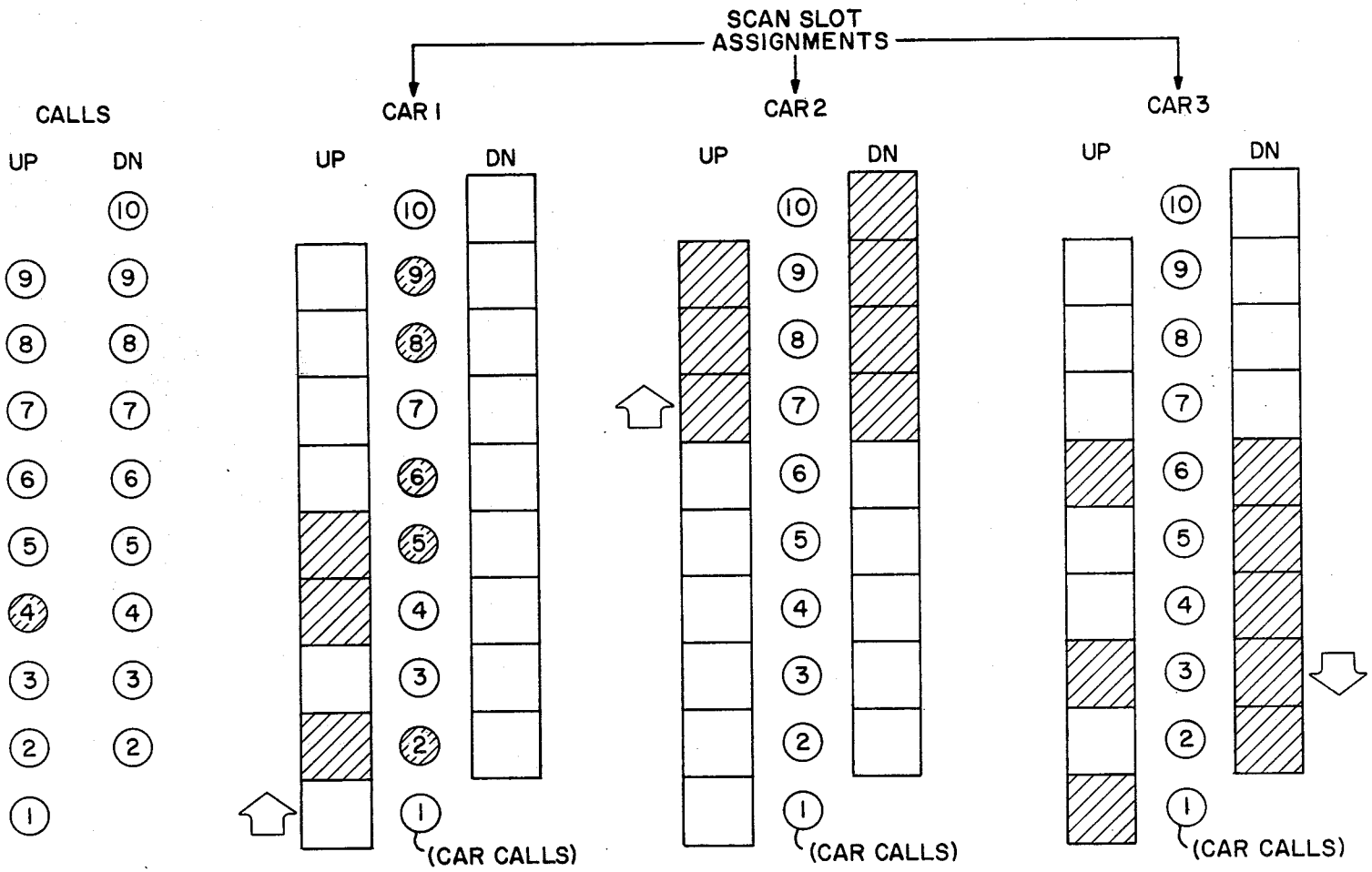

FIG. 5 is a chart which illustrates how this modification to the basic strategy improves upon the situation illustrated in both FIGS. 3 and 4. For purposes of example, the number of assignments of car call related scan slots to a car during the first assignment pass will be limited to the three closest stops to be made by that car, i.e., N=3.

Assume that car 1 has a hall call in the assigned up scan slot for the fourth floor, and it will thus retain this scan slot assignment, i.e., step 348 of FIG. 2 will not clear this scan slot assignment at the start of the next assignment process. The closest three stops for car 1 will be the stop at the second floor for the car call, the stop at the fourth floor for the hall call, and the stop at the fifth floor for the car call. Thus, only the scan slots associated with the car calls for the second and fifth floors will be assigned to car 1 during the first pass. Car 1 will be considered last for the general assignment of scan slots in subsequent assignment passes, since it is the busiest. Thus, cars 2 and 3 will receive scan slot assignments before car 1 is given scan slot assignments during subsequent passes.

Car 2 will receive assignments for up scan slots 7, 8 and 9, and for down scan slots 10, 9, 8 and 7. Car 3 will receive assignments for down scan slots 3 and 2, up scan slots for 1, 3 and 6, and down scan slots for 6, 5 and 4. If a hall call is registered from the sixth floor, car 3 will answer it, notwithstanding car 1 having a car call for the sixth floor. If an up hall call is registered for the 8and/or 9th floors, car 2 will respond, notwithstanding car 1 having car calls for these floors.

FIGS. 6 and 7 illustrate how the detailed flow chart for step 356 shown in FIG. 2 of the incorporated copending application Ser. No. 574,829, filed May 5, 1975, may be modified to implement the teachings of the first and second embodiments of the invention, respectively.

More specifically, FIG. 6 illustrates the implementation of the embodiment of the invention wherein the car call related scan slot assignments during the first assignment pass are limited to the N closest car calls to the location of the car in the building. Subprogram LCD14 is entered at terminal 890 and step 1000 is added to clear a count $N_{IS}$ which may be a count stored in a memory location, or in a hardware counter. The program then proceeds as in the incorporated application until shortly after step 940. If step 940 finds the scan slot being considered is not assigned, and step 942 determines that the assignment process is in the first assignment pass, step 944 checks to see if the car being considered has a car call for this scan slot and the car will be traveling in a direction from this floor after it serves the car call such that it could serve a subsequently registered hall call for this scan slot. If there is no car call, step 944 advances to step 966 which increments the slot count. If there is a car call, the modification of the first embodiment adds step 1002 which increments the count $N_{IS}$, previously cleared at the start of the program LCD14, Step 1004 then checks the magnitude of the count $N_{IS}$. If the selected number N is 2, for example, step 1004 checks to determine if $N_{IS}$ exceeds 2. If it does exceed 2, then this car will not be assigned this scan slot, at least during the first assignment pass, and the program advances to step 966. If the count $N_{IS}$ is not greater than 2, the car will be assigned to this scan slot, assuming it meets the calculated dynamic limitations or averages of the basic strategy described in the incorporated application.

FIG. 7 illustrates the implementation of the embodiment of the invention wherein the car call related scan slot assignments during the first assignment pass are limited to the N closest stops to which each car is already committed, either due to a hall call or a car call. Step 1000 clears the count $N_{IS}$, and the program proceeds as described in the incorporated application until reaching step 940. If step 940 finds the scan slot being considered is already assigned, step 1006 determines if the scan slot is assigned to the car currently being considered. If so, and this is the first assignment pass, determined by step 1007, this car will stop at this floor for a hall call, as it would only be assigned this scan slot if a hall call is associated with this scan slot, since step 348 of FIG. 2 would not clear this assignment to the car. If the scan slot is already assigned to this car, step 1007 advances to step 1008 which increments the count $N_{IS}$ and then the program advances to step 966 which advances the scan slot count. If the scan slot is assigned, but to some other car, step 1006 advances directly to step 966. If the scan slot is already assigned to this car but the assignment process is not in the first assignment pass, that program also advances to step 966.

If step 940 finds that the scan slot is not assigned, step 942 determines if the assignment process is in the first assignment pass. If it is not, the program advances to step 946 and the program continues as described in the incorporated application. If the assignment process is in the first pass, step 944 checks to see if there is a car call associated with this scan slot. If there is no car call, the program advances to step 966. If there is a car call, step 1010 increments the count $N_{IS}$ and step 1012 determines if the count $N_{IS}$ exceeds the predetermined selected number N, which for purposes of example will be assumed to be 3. If the count $N_{IS}$ exceeds 3, the car call is beyond the closest three stops that the car is committed to make and the scan slot associated with this hall call is not assigned to this car, at least during the first assignment pass. If the count $N_{IS}$ does not exceed 3, the scan slot associated with the car call is located within the three closest stops that the car will make, and it will be assigned to this car if it falls within the constraints of the dynamic limiting averages explained in the incorporated application.

In summary, there have been disclosed a new and improved elevator system, which improves upon the universal operating strategy set forth in the incorporated application. It recognizes the possibility of an adverse conflict between two separate operating strategies of the incorporated application, and precludes such adverse co-action without major modifications to the operating strategy.

We claim as our invention:

1. An elevator system for a building having a plurality of floors, comprising:

a plurality of elevator cars mounted in a building to serve the floors therein, car call means associated with each of said elevator cars for registering car calls, and supervisory control means assigning, clearing and reassigning service directions from the floors to said plurality of elevator cars according to a predetermined strategy, said supervisory control means including car call related means which assigns unassigned service directions ahead of each car associated with floors at which each car will stop due to registered car calls, and limit means limiting such car call related assignments to a predetermined number N per car, which are the N closest car calls ahead of the associated car.

2. The elevator system of claim 1 wherein the car call related means makes the car call related assignments each time the supervisory control means periodically clears assignments.

3. The elevator system of claim 1 wherein the supervisory control means assigns unassigned service directions to the cars in a plurality of assignment passes, considering each in-service car for assignment during an assignment pass before advancing to another assignment pass, and wherein the car call related means makes the car call related assignments in the initial assignment pass.

4. The elevator system of claim 1 including up and down hall call registering means for registering calls for elevator service for up and down service directions, respectively from at least certain of the floors, and wherein the supervisory control means periodically clears certain assignments and retains certain assignments, with an assignment being retained if it is associated with a floor service direction ahead of the car which has a registered hall call associated therewith.

5. An elevator system for a building having a plurality of floors, comprising:

a plurality of elevator cars, means mounting said plurality of elevator cars for movement relative to the floors, up and down hall call registering means for registering calls for elevator service for up and down service directions, respectively, from at least certain of the floors, car call means associated with each of said elevator cars for registering car calls, assignment means assigning service directions from floors to said elevator cars according to a predetermined strategy, and clearing means periodically clearing the assignments of those service directions from the floors which do not have a registered hall call associated therewith, said assignment means reassigning said cleared assignments to said elevator cars according to the predetermined strategy, said assignment means including first means which assigns unassigned service directions from floors to each car related to the floors at which the car will stop due to registered car calls, and the direction in which the car will leave such floors, and second means responsive to the number of such car call related assignments given to a car for limiting the number of such assignments by said first means to N per car.

6. The elevator system of claim 5 wherein the assignment means includes third means which assigns unassigned service directions to the elevator cars, starting at the location of each car, and proceeding in a predetermined service direction therefrom, and wherein said third means makes such assignments after the first means completes the car call related assignments to all of the plurality of elevator cars.

7. The elevator system of claim 5 wherein the first means considers the car calls in the order in which they will be served, when making the car call related assignments, such that when the second means indicates that N such assignments have been made, they will be the N closest car calls to the location of the associated elevator car.

8. An elevator system for a building having a plurality of floors, comprising:

a plurality of elevator cars mounted in the building to serve the floors therein, car call means associated with each of said elevator cars for making car calls, up and down hall call registering means for registering calls for elevator service for up and down service directions, respectively, from at least certain of the floors, supervisory control means assigning, clearing, and re-assigning service directions from the floors to said plurality of elevator cars according to a predetermined strategy, said supervisory control means including car call related means which assigns unassigned service directions ahead of each car associated with those floors at which each car will stop due to a registered car call, and limit means limiting such car call related assignments to the closest N stops ahead of each car to which the car is already committed.

9. The elevator system of claim 8 wherein the car call related means makes the car call related assignments each time the supervisory control means periodically clears assignments.

10. The elevator system of claim 8 wherein the supervisory control means assigns unassigned service directions to the cars in a plurality of assignment passes, considering each in-service car for assignment during an assignment pass before advancing to another assignment pass, and wherein the car call related means makes the car call related assignments in the initial assignment pass.

11. The elevator system of claim 8 wherein the supervisory control means periodically clears certain assignments and retains certain assignments, with an assignment being retained if it is associated with a floor service direction ahead of the car which has a registered hall call associated therewith.

12. An elevator system for a building having a plurality of floors, comprising:

a plurality of elevator cars, means mounting said plurality of elevator cars for movement relative to the floors, up and down hall call registering means for registering calls for elevator service for up and down service directions, respectively, from at least certain of the floors, car call means associated with each of said cars for registering car calls, assignment means assigning service directions from floors to said elevator cars according to a predetermined strategy, and clearing means periodically clearing the assignments of those service directions from the floors which do not have a registered hall call associated therewith, said assignment means reassigning said cleared assignments to said elevator cars according to the predetermined strategy, said assignment means including first means which starts at the floor associated with the location of each car and proceeds in a predetermined direction therefrom, assigning only those unassigned service directions to each car which are related to the floors at which the car will stop due to registered car calls, and second means responsive to the sum of such car call related assignments and any preexisting assignments to each car which are encountered as the car call related assignments are being made, to count the number of stops to be made by each car, with said second means limiting such car call related assignments to the N closest stops to be made by each elevator car.

13. The elevator system of claim 12 wherein the assignment means includes third means which, according to a predetermined strategy, assigns the unassigned service directions to the elevator cars which remain after the first means completes the car call related assignments to all of the plurality of elevator cars.

* * * * *